United States Patent [19]

Gefvert

[11] 4,245,930

[45] Jan. 20, 1981

[54] OFFSHORE DRILLING AND PRODUCTION

[75] Inventor: Leland V. Gefvert, Anchorage, Ak.

[73] Assignee: Atlantic Richfield Company, Los Angeles, Calif.

[21] Appl. No.: 45,817

[22] Filed: Jun. 6, 1979

[51] Int. Cl.[3] ..... E02B 3/00; F25C 1/02

[52] U.S. Cl. ..... 405/217; 405/60

[58] Field of Search ..... 405/217, 60, 211–216, 405/195, 63–72

[56] References Cited

U.S. PATENT DOCUMENTS

| | | | |
|---|---|---|---|
| 3,863,456 | 2/1975 | Durning | 405/217 |
| 4,048,808 | 9/1977 | Duthweiler | 405/217 |
| 4,192,630 | 3/1980 | Duthweiler | 405/217 |

FOREIGN PATENT DOCUMENTS

| | | | |
|---|---|---|---|
| 1013955 | 7/1977 | Canada | 405/217 |

*Primary Examiner*—Dennis L. Taylor

*Attorney, Agent, or Firm*—Roderick W. MacDonald

[57] ABSTRACT

An offshore well drilling and/or production operation which is carried out on top of a layer of ice which extends over unfrozen water. A ring of thermal insulation is formed on top of the ice around the area of the drilling and/or production operation so that the ice thickness under the ring is thinner than the ice adjacent the ring thereby forming an annular depression in the underside of the ice. The depression will capture and hold any hydrocarbons or other fugitive materials that may escape under the ice in the area of the drilling and/or production operation.

6 Claims, 2 Drawing Figures

OFFSHORE DRILLING AND PRODUCTION

BACKGROUND OF THE INVENTION

In far northern offshore well drilling and/or production locations such as in the Arctic, a layer of ice of substantial thickness forms during the winter months, and in many cases such operations can be carried out best from the surface of the ice. This means that such operations will be carried out on solid ice but that below the ice a layer of unfrozen water will be encountered before the surface of the earth is reached.

Should any liquid or gaseous material which is lighter than water escape from the earth's surface or from pipe in the liquid water, these escaped materials could be, unless special steps are taken, free to spread while being protected from surface access by the ice layer.

Accordingly, when drilling and/or production operations are carried out when the ice layer is present, it is preferable to have some pre-arranged means and method for capturing fugitive hydrocarbons and the like that may reach the water layer between the ice and the earth's surface.

SUMMARY OF THE INVENTION

In accordance with this invention, in an offshore drilling and/or production operation which is carried out on top of an ice layer which extends over unfrozen water, a ring of thermal insulating material is formed around the area of the operation so that the ice thickness under the ring is thinner than the ice thickness adjacent the ring thereby forming an annular depression in the underside of the ice and surrounding the area of the operation. Any fugitive hydrocarbon, etc., that may escape under the ice in the unfrozen water will rise to the water-ice interface and, if it tends to spread, will be trapped and collected in the depression.

This invention also relates to an offshore hydrocarbon drilling and/or production operation on top of ice wherein an annular depression means is employed on the bottom side of the ice sourrounding the operation.

Accordingly, it is an object of this invention to provide a new and improved offshore drilling and/or production operation. It is another object to provide a new and improved method for carrying out drilling and/or production operations offshore and on ice.

Other aspects, objects and advantages of this invention will be apparent to those skilled in the art from this disclosure and the appended claims.

DETAILED DESCRIPTION OF THE INVENTION

Figure 1:
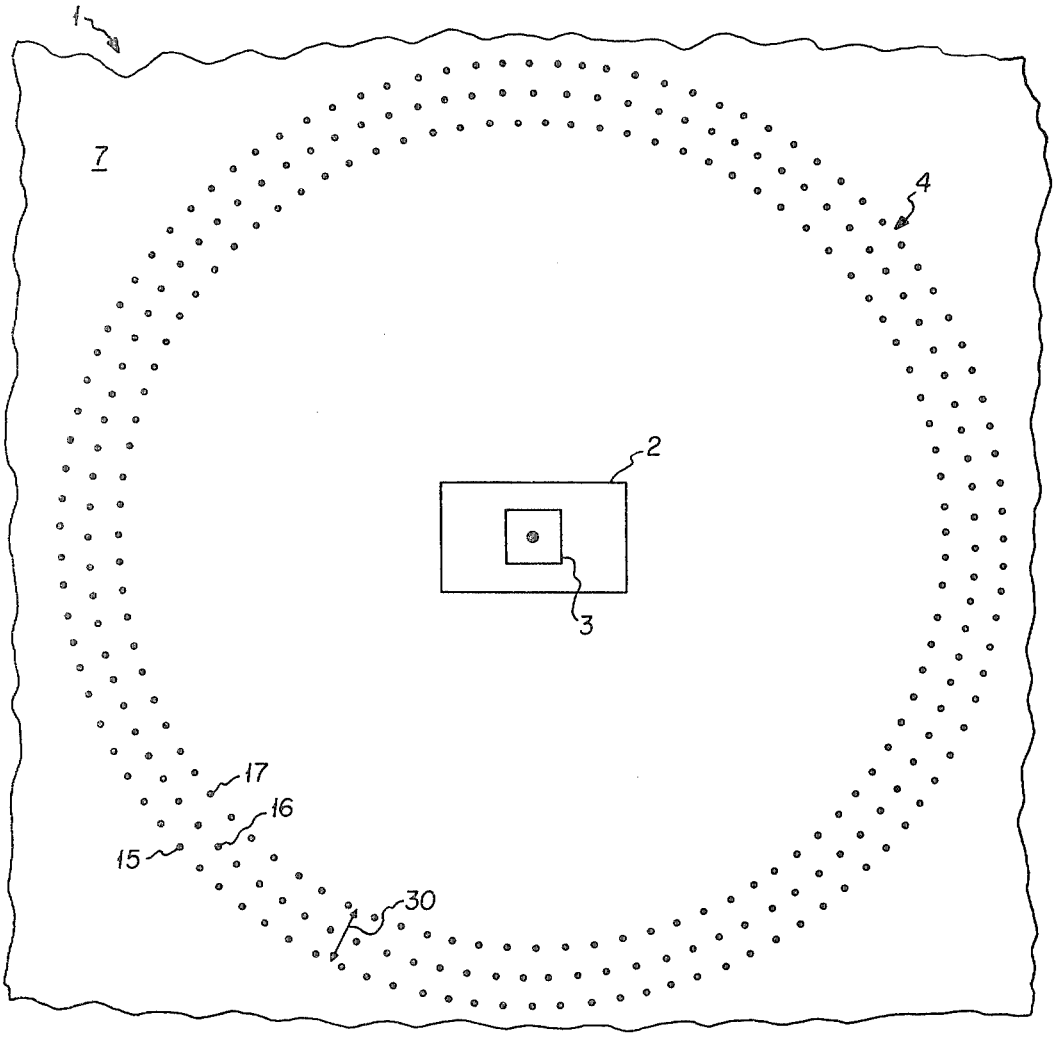
FIG. 1 shows a top view of one embodiment of a drilling operation in accordance with this invention.

More specifically, FIG. 1 shows a section of ice 1 which overlays a body of water (not shown). Ice 1 carries on its upper surface 7 a drilling pad 2 which supports a drilling rig 3. Drilling pad 2 is surrounded by a ring of thermal insulating material 4 which will be described in greater detail hereinafter.

Figure 2:
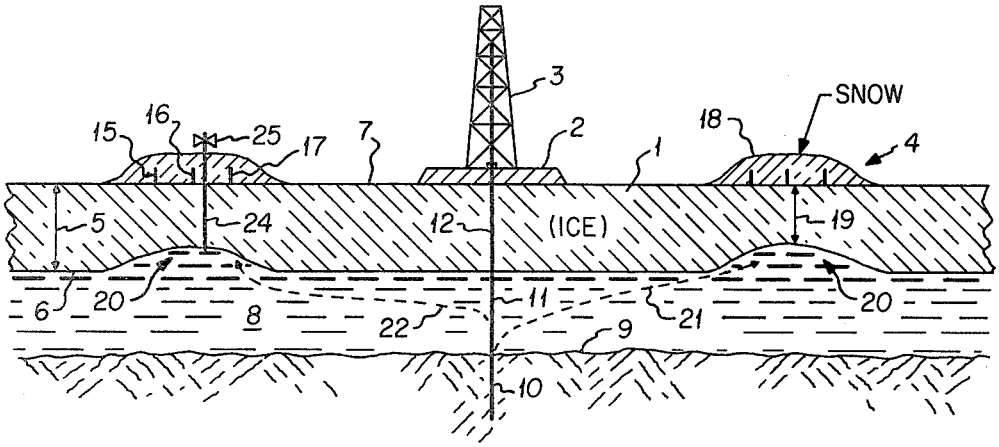
FIG. 2 shows an elevational section of the operation of FIG. 1.

FIG. 2 shows ice layer 1 with upper surface 7 supporting drilling pad 2. Pad 2 supports drilling rig 3 and is employed to prevent drilling operations from melting ice layer 1.

Ice layer 1, in areas where surface 7 is not covered by snow or other thermal insulating material, has a finite thickness 5 extending between upper or top surface 7 and lower or bottom surface 6 of layer 1.

Below bottom ice surface 6 is a body of unfrozen water 8 and below water body 8 is the surface of the earth 9.

In the embodiment of this invention represented in FIG. 2, a wellbore 10 is being drilled in the earth's surface below rig 3 and this necessitates drill pipe 11 to extend from rig 3 into wellbore 10. Pipe 11 extends through a hole 12 which has been drilled through ice layer 1.

In the embodiment of FIG. 2, three concentric circles of conventional snow fence 15, 16 and 17 are employed to form a ring around the drilling operation. The snow fence is employed to catch and keep snow 18 piled up around the drilling operation thereby providing thermal insulation ring 4 around the operation. Because of its thermal insulating effects ring 4 causes the ice thickness 19 under this annulus of snow to be thinner than normal thickness 5 where no thermal insulation covers upper surface 7. Due to thinner thickness 19 an annular depression 20 is formed in the bottom surface 6 of ice layer 1. Depression 20 encircles the drilling operation.

Should any fugitive liquid and/or gaseous hydrocarbons or other liquids or gases which are lighter than water escape from the earth's surface in the vicinity of wellbore 10 as shown by dotted line 21 and/or escape from drill pipe 11 as shown by dotted line 22, such fugitive materials will tend to rise towards bottom surface 6 and, if they tend to spread out to any great extent, will migrate as shown by arrows 21 and 22 upwardly into depression 20 where they will be captured and retained until appropriate man-made disposition can be arranged at the surface 7. For example, pipe 24 with valve 25 thereon can be disposed through ice layer 1 into communication with the upper part of depression 20 so that liquid and/or gaseous material trapped in depression 20 can be removed in a controlled manner for collection and storage on upper surface 7. If a substantial amount of liquid and gaseous hydrocarbon is collected in depression 20 so that depression 20 is becoming filled, pipe 24 can be used as a gas vent means to remove gas from depression 20 thereby leaving the entire volume of depression 20 available for the collection of fugitive liquids. Pipe 24 can be installed before it is needed, but preferably is installed only when needed to avoid plugging with ice when not in use.

Man-made insulating means as well as natural insulating means such as snow can be employed to form annular ring 4. For example, polyurethane or other thermal insulating strips can be laid on surface 7 and combination of one or more man-made insulating materials with or without natural insulation such as snow can be employed, for example in areas where driveway access through ring 4 is desired. The width of ring 4 can be varied as desired to increase or decrease the storage capacity of depression 20. The insulating means is preferably employed while ice layer 1 is growing in thickness but can be employed after substantial formation of the ice layer if desired or necessary.

Ring 4, because of its raised elevation on upper surface 7 can also serve as an embankment for containing any fugitive liquids on upper surface 7. Ring 4 can also help reduce the consequences of white-outs caused by blowing snow in the vicinity of drilling rig 3 and thereby permit certain operations to continue that might otherwise have to be halted for safety reasons due to a lack of visibility. When this invention is practiced, it may be desirable to keep the area inside the ring and a reasonable but limited area outside the ring clear of snow or other insulating material so that the only substantial depression in the underside of the ice layer in the near vicinity of the drilling and/or production operation is depression 20.

EXAMPLE

In environmental conditions which normally obtain in the Arctic Ocean in March, the ice layer is about five feet thick whereas under a pile of snow one foot high, the ice would be about four feet thick.

If three concentric rings of snow fence are employed as shown in FIG. 1 with ring 17 having a diameter of 1120 feet, ring 16 a diameter of 1200 feet and ring 15 a diameter of 1280 feet, the impounded windblown snow would form a ring having an annular width 30 in FIG. 1 of about 80 feet. With the one foot differential between thickness 5 (five feet) and thickness 19 (four feet), depression 20 would have a liquid storage volume of over 50,000 barrels (42 U.S. gallons per barrel). Even if the efficiency of this system was only 25% due to an inability to deploy snow fence until late in the season or other factors, depression 20 could still have a storage capacity in the thousands of barrels which is quite substantial and useful as a capturing basin for fugitive material.

Reasonable variations and modifications are possible within the scope of this disclosure without departing from the spirit and scope of this invention.

The embodiments of the invention in which an exclusive property or privilege is claimed are defined as follows:

1. In a method for carrying out an offshore well drilling and/or production operation which is carried out on top of an existing layer of ice over unfrozen water, the improvement comprising forming a ring of thermal insulating material on top of said existing ice around the area of said operation, said ring being of sufficient height and width so that the ice thickness under said ring becomes thinner than the ice thickness adjacent said ring but without downwardly deforming said existing ice, thereby forming an annular depression in the underside of said ice around the area in which said operation is carried out, whereby any fugitive fluid that is lighter than water that may escape under said ice in said unfrozen water will essentially collect in said depression.

2. A method according to claim 1 wherein said insulating material is a pile of snow.

3. A method according to claim 1 wherein said insulating material is at least one layer of at least one man-made material.

4. A method according to claim 1 wherein said insulating material is a combination of snow and at least one man-made material.

5. A method according to claim 1 wherein, if liquid hydrocarbon is trapped in said depression and gaseous materials are also trapped, said depression is vented in a controlled manner to the surface of said ice to remove at least said trapped gaseous materials.

6. A method according to claim 1 wherein said insulating material is disposed on the top of said ice so as to serve as containment means for any liquid spill on top of said ice in the area of said operation.

* * * * *